US006378740B1

(12) United States Patent
Martin

(10) Patent No.: US 6,378,740 B1
(45) Date of Patent: Apr. 30, 2002

(54) PORTABLE FROZEN BEVERAGE DISPENSER

(75) Inventor: Gary D. Martin, Lewisville, TX (US)

(73) Assignee: Mush, Inc., Lewisville, TX (US)

( * ) Notice: Subject to any disclaimer, the term of this patent is extended or adjusted under 35 U.S.C. 154(b) by 0 days.

(21) Appl. No.: 09/596,731

(22) Filed: Jun. 16, 2000

(51) Int. Cl.[7] ..... B67D 5/42
(52) U.S. Cl. ..... 222/389; 222/334
(58) Field of Search ..... 222/389, 387, 222/399, 334

(56) References Cited

U.S. PATENT DOCUMENTS

| | | | | |
|---|---|---|---|---|
| 2,513,455 | A | 7/1950 | Cornelius | 222/146 |
| 2,732,977 | A | 1/1956 | Charpiat | 222/131 |
| 3,286,884 | A | 11/1966 | Long, Jr. | 222/131 |
| 3,662,929 | A | 5/1972 | Sims | 222/386.5 |
| 4,869,402 | A | 9/1989 | Ash, Jr. | 222/209 |
| 4,921,143 | A | 5/1990 | Billet | 222/175 |
| 5,069,364 | A | 12/1991 | McGill | 222/95 |
| 5,150,820 | A | 9/1992 | McGill | 222/95 |
| 5,199,609 | A | 4/1993 | Ash, Jr. | 222/94 |
| 5,246,140 | A | 9/1993 | Thix et al. | 222/4 |
| 5,385,275 | A | 1/1995 | Billet | 222/399 |
| 5,405,054 | A | 4/1995 | Thomas | 222/95 |
| 5,421,484 | A | 6/1995 | Beach | 222/95 |
| 5,492,249 | A | 2/1996 | Beach | 222/96 |
| 5,505,336 | A | 4/1996 | Montgomery et al. | 222/82 |
| 5,529,220 | A | 6/1996 | Credle, Jr. et al. | 222/175 |
| 5,772,075 | A | 6/1998 | Ash, Jr. et al. | 222/1 |
| 6,082,589 | A | 7/2000 | Ash et al. | 222/146.6 |
| 6,098,849 | A | 8/2000 | McInnes | 222/175 |

*Primary Examiner*—Kevin Shaver
*Assistant Examiner*—Melvin A. Cartagena
(74) *Attorney, Agent, or Firm*—Michael A. O'Neil

(57) ABSTRACT

A portable frozen beverage dispenser includes a frozen beverage receiving container and a piston mounted within the container for pressurizing a frozen beverage received therein. The piston is actuated either pneumatically or mechanically. The frozen beverage receiving container and the frozen beverage contained therein are received and transported in an insulated backpack.

4 Claims, 5 Drawing Sheets

PORTABLE FROZEN BEVERAGE DISPENSER

TECHNICAL FIELD

This invention relates generally to the dispensing of frozen beverages, and more particularly to a portable frozen beverage dispenser which is particularly useful at concerts, sports events, and other large gatherings.

BACKGROUND AND SUMMARY OF THE INVENTION

Frozen beverages are widely enjoyed by persons of all ages. As is well known, frozen beverages are not actually frozen, but instead comprise mixtures of crushed or shaved ice and a flavor-containing liquid. Non-alcoholic frozen beverages are dispensed at convenience stores and similar outlets with flavorings such as strawberry, lemon-lime, root beer, cola, etc. Frozen margaritas and similar alcohol containing frozen beverages are enjoyed by adults at bars and restaurants.

Frozen beverages are prepared in machines adapted to first mix the crushed or shaved ice and the flavor containing liquid and thereafter to prevent the flavor containing liquid from separating from the crushed or shaved ice. The machine further includes apparatus for dispensing the frozen beverage contained therein directly into a serving container such as a plastic cup, etc. The dispensing of frozen beverages directly from the mixing machine is satisfactory in the case of convenience stores and similar outlets, bars, restaurants, etc., where the rate of beverage consumption per unit of time is relatively small. However, in the case of concerts, sports events and other large gatherings, attempts to dispense frozen beverages from mixing machines result in long lines which in turn result in irritation on the part of beverage customers.

The foregoing problem can be remedied by providing a portable frozen beverage dispenser. In this manner frozen beverages can be served to customers without requiring the customers to go to the location of frozen beverage dispensing machines. However, prior to the present invention, attempts at providing a satisfactory portable frozen beverage dispenser have been unsuccessful.

For example, one attempt at providing the portable frozen beverage dispenser involved receiving the frozen beverage in a container, then attempting to dispense the frozen beverage from the bottom of the container under the action of gravity. Such a device does not operate satisfactorily because the flavor containing liquid drains from the ice leaving a flavorless clump of crushed or shaved ice in the bottom of the container. Another unsuccessful attempt involved locating an inflatable balloon within the frozen beverage receiving container in an attempt to force the frozen beverage therefrom under pressure.

The present invention comprises a portable frozen beverage dispenser which overcomes the foregoing and other difficulties which have long since characterized the prior art. In accordance with the broader aspects of the invention, a frozen beverage is received in the lower portion of a container and a piston is received in the upper portion of the container above the frozen beverage. Pressure is applied to the piston to force the frozen beverage out of the container without causing separation of the flavor containing liquid from the crushed or shaved ice. In this manner frozen beverages are dispensed from the portable frozen beverage dispenser of the present invention at the same quality level which characterizes the dispensing of frozen beverages directly from frozen beverage mixing machines.

In accordance with more specific aspects of the invention, pressure is applied to the piston which forces the frozen beverage out of the container either pneumatically or mechanically. The container may be filled with the frozen beverage to be dispensed by removing the piston from the container, filling the container with the frozen beverage to be dispensed, then reinstalling the piston. Alternatively, the frozen beverage dispenser of the present invention may be provided with apparatus for receiving the frozen beverage to be dispensed directly from a frozen beverage mixing machine.

In use, the portable frozen beverage dispenser of the present invention is received in an insulated backpack. In this manner, the portable frozen beverage dispenser is easily transported to the attendees at concerts, sports events, and other large gatherings. This in turn facilitates the dispensing of frozen beverages directly to customers wishing to purchase the beverages without requiring the customers to visit the location of the frozen beverage mixing machines.

BRIEF DESCRIPTION OF THE DRAWINGS

A more complete understanding of the invention may be had by reference to the following Detailed Description when taken in conjunction with the accompanying Drawings, wherein.

DETAILED DESCRIPTION

Figure 1:
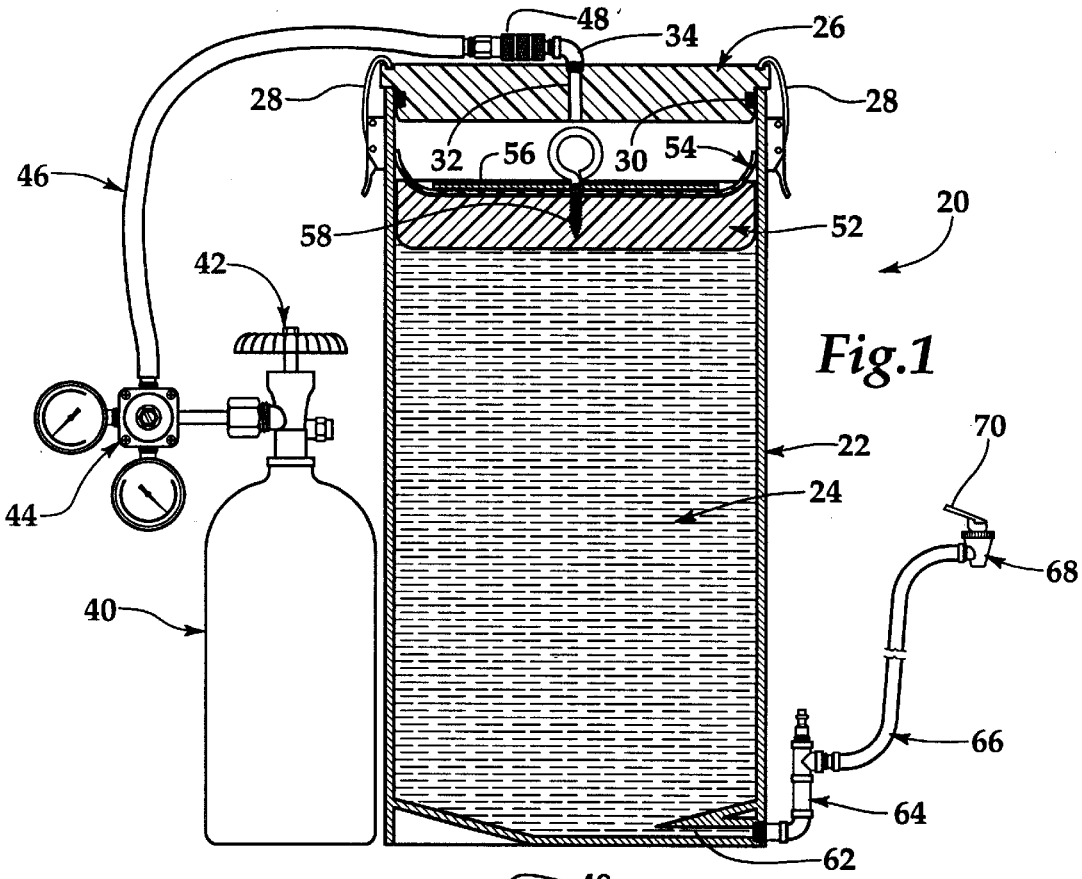
FIG. 1 is a sectional view illustrating a portable frozen beverage dispenser comprising the preferred embodiment of the invention.
Figure 2:
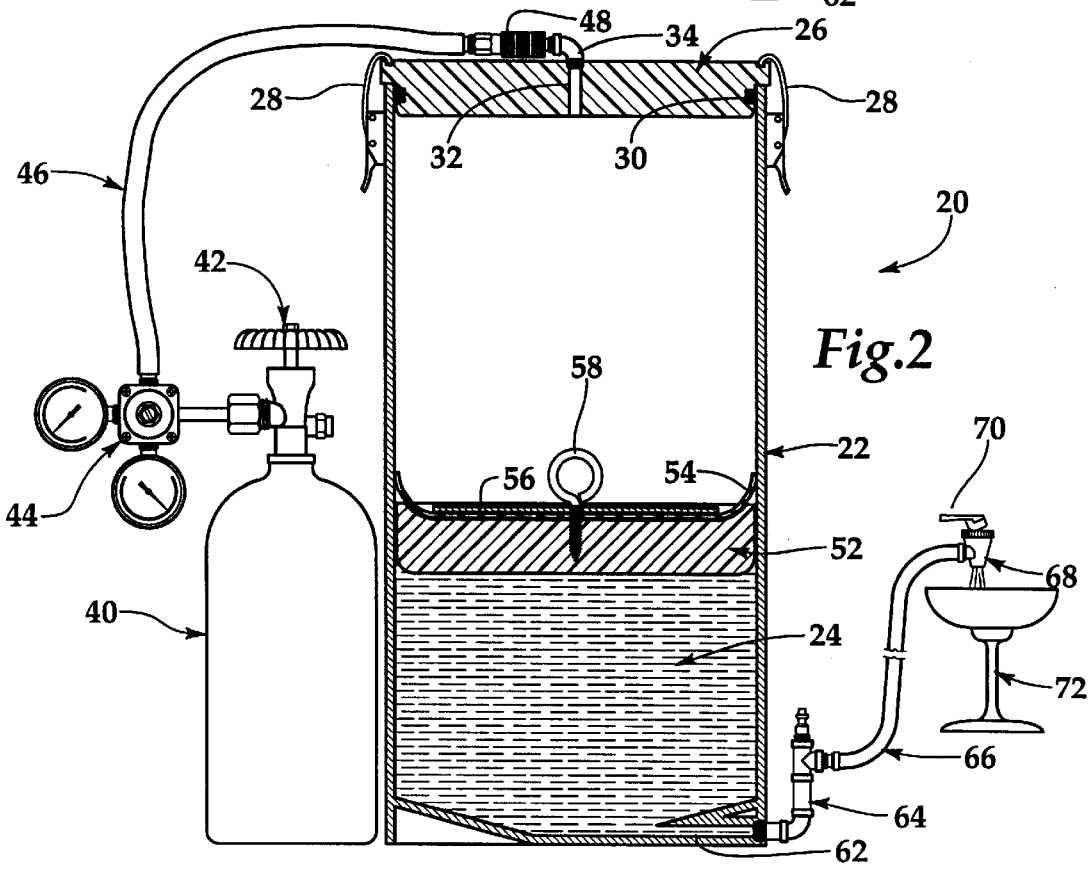
FIG. 2 is a view similar to FIG. 1 illustrating the operation of the portable frozen beverage dispenser of the present invention.

Referring now to the Drawings, and particularly to FIGS. 1 and 2 thereof, there is shown a portable frozen beverage dispenser 20 comprising the preferred embodiment of the invention. The dispenser 20 includes a container 22 adapted to receive a frozen beverage 24 therein. The container 22 is preferably formed from stainless steel, however, other materials particularly including plastic materials may be utilized in the construction of the container 22 depending upon the requirements of particular applications of the invention.

The container 22 is provided with a lid 26. The lid 26 is secured on top of the container 22 by a plurality of fasteners 28. The fasteners 28 preferably comprise toggle-type fasteners as shown, however, other types and kinds of fasteners may be utilized in the practice of the invention, if desired.

The lid 26 is provided with an O-ring 30. The O-ring 30 engages the interior of the container 22 to form a pressure tight seal there between. A passageway 32 extends through the lid 26 and communicates with the interior of the container 22. The passageway 32 extends to a hollow fitting 34.

The portable frozen beverage dispenser 20 further includes a pressure vessel 40 which is filled with a compressed gas. A valve 42 directs compressed gas from the pressure vessel 40 to a regulator 44. The regulator 44 directs compressed gas at a predetermined pressure which is typically substantially lower than the pressure within the pressure vessel 40 to a hose 46 which is connected to the fitting 34 by a quick disconnect coupling 48. It will therefore be understood that the valve 42, the regulator 44, the hose 46, the coupling 48, the hollow fitting 34, and the passageway 32 function to direct compressed gas from the pressure vessel 40 into the upper portion of the container 22.

A piston 52 is positioned in the container 22 above the frozen beverage received therein and below the lid 26. The piston 52 is provided with a seal 54 which is retained by a plate 56 and a fastener 58. Upon actuation of the valve 42, compressed gas from the pressure vessel 40 imposes a downwardly directed force on the piston 52 thereby exerting pressure on the frozen beverage 24 within the container 22.

The lower portion of the container 22 is provided with an outlet 62. A hollow fitting 64 is connected to the outlet 62 and a hose 66 is in turn connected to the fitting 64. The hose 66 extends to a normally closed dispensing valve 68 which is actuated by a lever 70. Upon actuation of the lever 70, the frozen beverage 24 is discharged from the container 22 through the outlet 62, the fitting 64, the hose 66, the valve 68 under the action of pressure imposed thereon by the piston 52 which is in turn actuated by gas from the pressure vessel 40 which enters the portion of the container 22 above piston 52 through the valve 42, the regulator 44, the hose 46, the coupling 48, the hollow fitting 34, and the passageway 32.

The dispensing of the frozen beverage 24 from the container 22 is further illustrated in FIG. 2. As the frozen beverage 24 is dispensed into serving containers such as the container 72, the level of the frozen beverage 24 within the container 22 drops. However, the pressure imposed on the piston 52 by the gas from the pressure vessel 40 remains constant under the action of the regulator 44. Thus, the dispensing of the frozen beverage 24 through the valve 68 remains constant until substantially all of the frozen beverage has been discharged.

Figure 3:
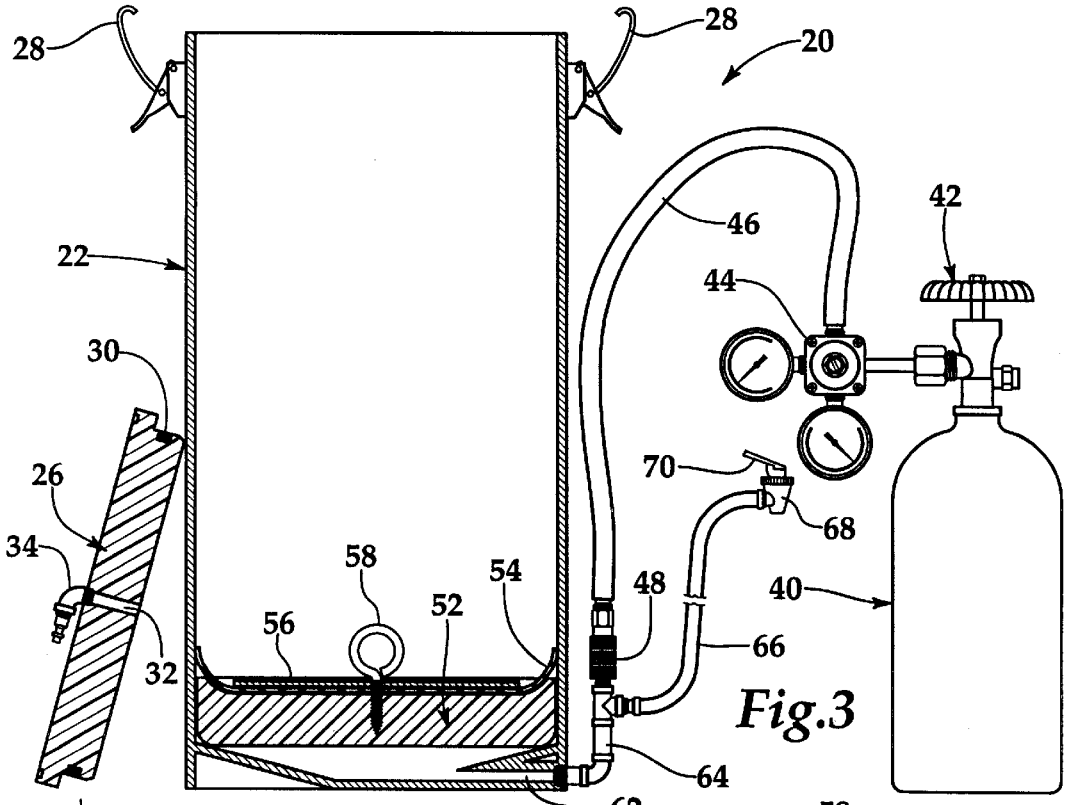
FIG. 3 is a view similar to FIG. 1 illustrating an early step in the filling of the portable frozen beverage dispenser with a frozen beverage to be dispensed.
Figure 4:
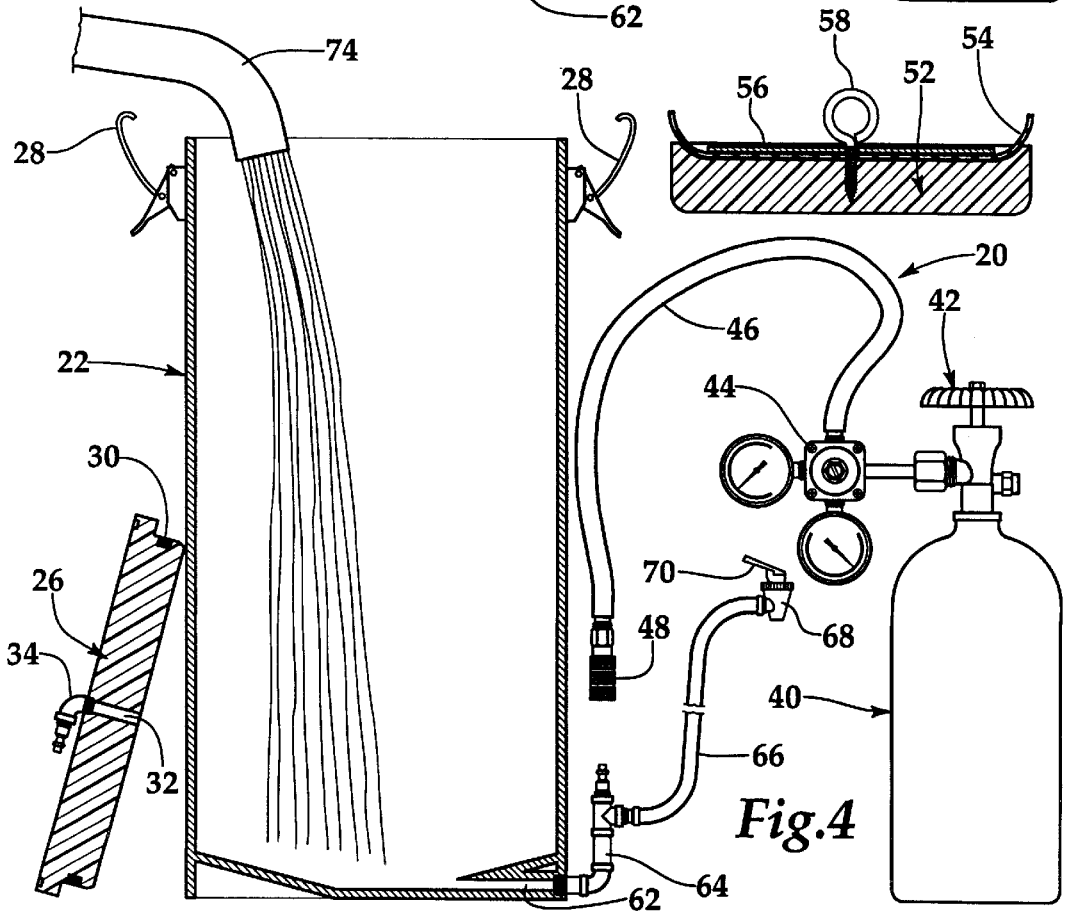
FIG. 4 is a view similar to FIG. 3 illustrating a subsequent step in the filling procedure.

The filling of the container 22 of the frozen beverage is illustrated in FIGS. 3 and 4. First, the valve 42 is closed and the quick disconnect coupling 48 is removed from the fitting 34, thereby releasing pressure from within the interior of the container 22. The fasteners 28 are released and the lid 26 is removed from the top of the container 22.

The quick disconnect coupling 48 is engaged with the fitting 64 and the valve 42 is re-opened. Pressurized gas from the pressure vessel 40 flows through the valve 42, the regulator 44, the hose 46, the quick disconnect coupling 48, the fitting 64, and the outlet 62 into the bottom of the container 22. Pressure is thereby imposed on the bottom of the piston 52 which drives the piston 52 upwardly and out of the container 22. The container 22 is then filled with a frozen beverage from a hose 74 extending from a frozen beverage mixing machine.

Figure 5:
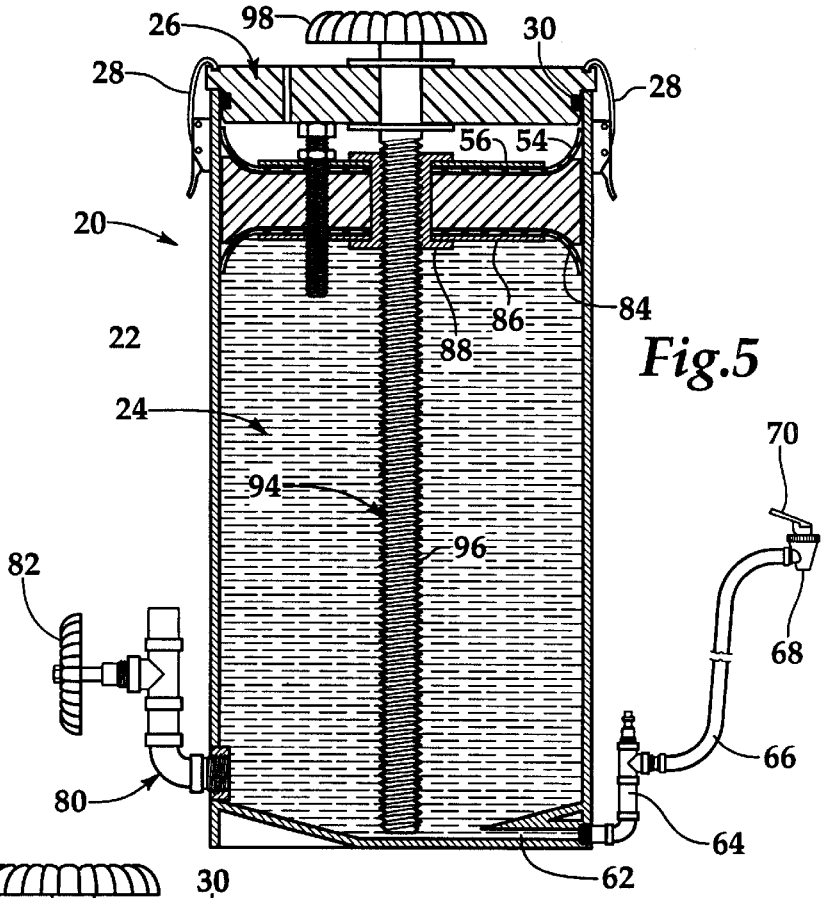
FIG. 5 is a view similar to FIG. 1 illustrating various alternative constructions which may be utilized in the practice of the invention.
Figure 6:
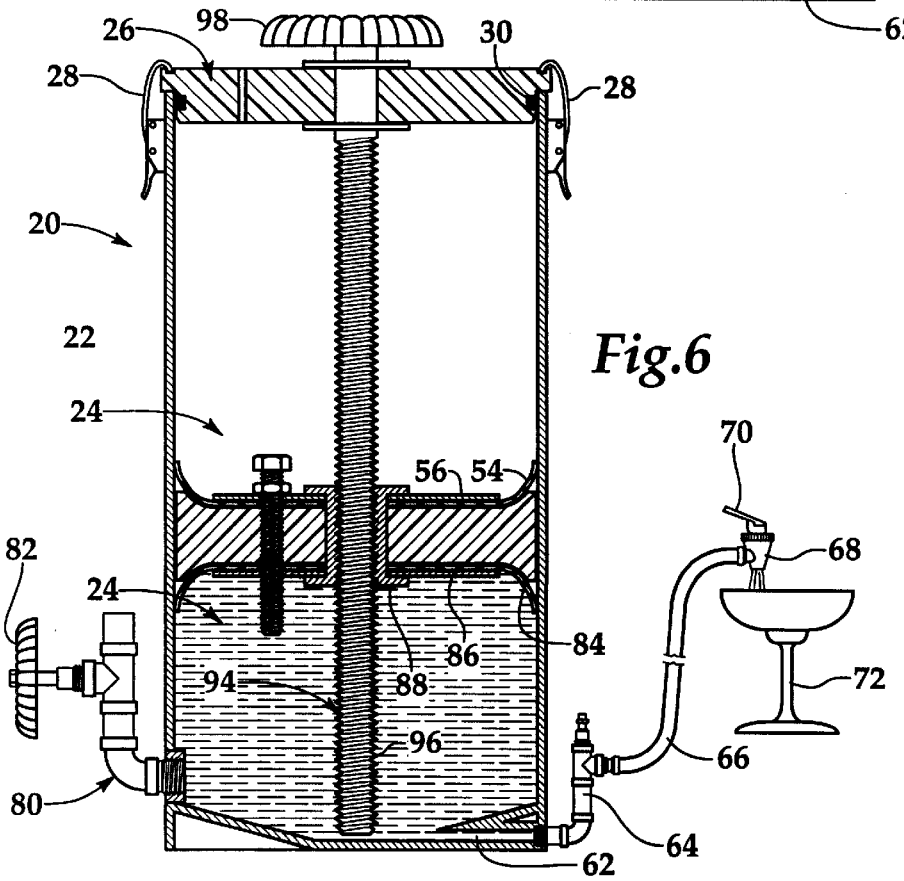
FIG. 6 is a view similar to FIG. 5 further illustrating the various alternative constructions thereof.

FIGS. 5 and 6 illustrate several options which may be utilized in conjunction with the portable frozen beverage dispenser 20 illustrated in FIGS. 1–4, inclusive, and described hereinabove in conjunction therewith. The container 22 may be provided with a fitting 80 having a normally closed valve 82. The fitting 80 is adapted for connection to a hose comprising an outlet from a frozen beverage mixing machine. Thus, the fitting 80 facilitates refilling of the container 22 with a frozen beverage to be dispensed therefrom without requiring the removal of the lid 26 and the piston 52.

When the fitting 80 is used to effect refilling of the container 22, the piston 52 is preferably provided with a seal 84 which is secured on the bottom side of the piston 52 by a plate 86 and a suitable fastener 88. The seal 84 prevents the frozen beverage 24 from seeping part the piston 52 as the container 22 is refilled.

When the fitting 80 is used to refill the container 22 with the frozen beverage 24, the piston 52 may be provided with a stop 92. The stop 92 is variably positionable on the piston 52 and serves to limit upward movement of the piston 52 as the container 22 is refilled. In this manner, the amount of frozen beverage 24 which is added to the container through the fitting 80 may be controlled.

FIGS. 5 and 6 also illustrate a mechanical apparatus 94 which may be used in lieu of the pressurized gas from the pressure vessel 40 to impose a downwardly directed force on the piston 52. The particular mechanical apparatus 94 illustrated in FIGS. 5 and 6 comprises a lead screw 96 which is threadedly engaged with the piston 52. The lead screw 96 extends through the lid 26 and is provided with an actuation handle 98. Upon rotation of the lever 98, a downwardly directed force is imposed on the piston 52 which in turn imposes pressure on the frozen beverage 24 within the container 22. By this means, the frozen beverage is discharged through the valve 68 upon actuation of the lever 70.

Those skilled in the art will appreciate the fact that mechanical devices 94 other than the lead screw 96 may be utilized to impose a downwardly directed force on the piston 52. In particular, a rachet-type mechanism similar to our automobile jack may be utilized to impose a downwardly directed force on the piston 52.

Those skilled in the art will also understand that it is not necessary to use all of the components illustrated in FIGS. 5 and 6 simultaneously, and that the components shown therein can be selectively employed in the portable frozen beverage dispenser 20 as shown in FIGS. 1 and 2. For example, a mechanical device such as a lead screw or a jack can be used to actuate a piston 52 of the type shown in FIGS. 1 and 2 in lieu of pressurized gas. In such an event, the mechanical piston actuating device is removed with the lid 26 to effect refilling of the container 22.

Conversely, the fitting 80 and a piston 52 of the type shown in FIGS. 5 and 6 can be used in conjunction with the portable frozen beverage dispenser of FIGS. 1 and 2, in which event the piston is actuated by pressurized gas instead of the mechanical device of FIGS. 5 and 6. The use of the stop 92 is entirely optional, and the use thereof can be omitted depending upon the requirements of particular applications of the invention.

Figure 7:
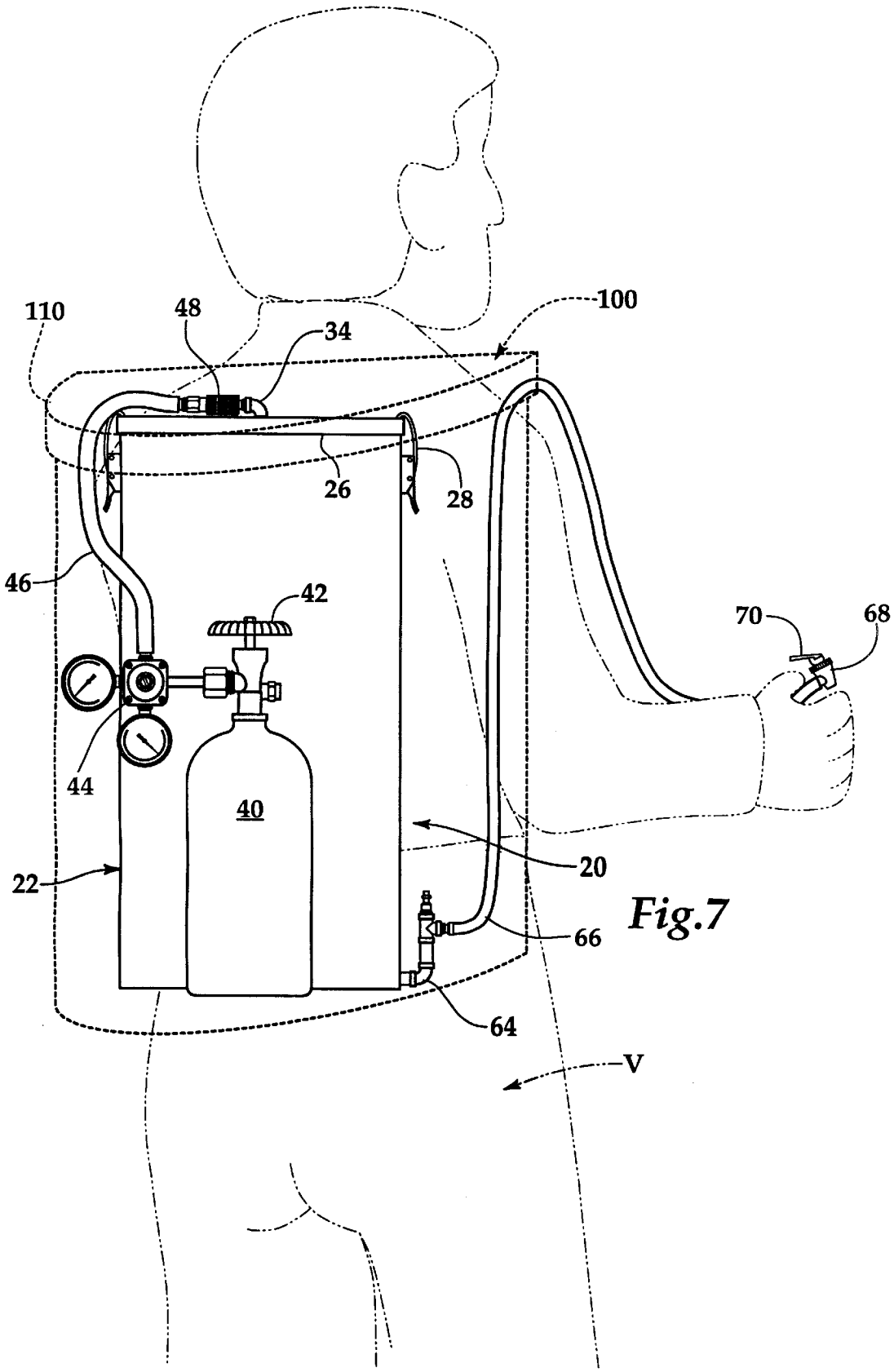
FIG. 7 is a diagrammatic illustration of the use of the portable frozen beverage dispenser of the present invention.

The use of the portable frozen beverage dispenser 20 of the present invention is illustrated in FIG. 7 The portable frozen beverage dispenser 20 preferably includes an insulated backpack 100 which is carried by a vendor V. The hose 66 extends out of the insulated backpack 100 and downwardly along the arm of the vendor V for actuation by one hand while the other hand holds a container for receiving the frozen beverage container from the container 22 which is discharged through the valve 68 upon actuation of,the lever 70. In most applications of the invention, the vendor V would receive payment for the frozen beverage simultaneously with the dispensing thereof.

The use of the present invention allows the vendor V to pass through the attendees at a large gathering such as concerts, athletic events, etc. The vendor V dispenses frozen beverages to those persons among the attendees wishing to make such a purchase until the entire contents of the container 22 has been dispensed. At this point, the vendor V returns to the frozen beverage mixing machine to refill the container 22. In this manner the necessity of individual attendees traveling to the frozen beverage mixing machine to purchase a frozen beverage is eliminated.

Figure 8:
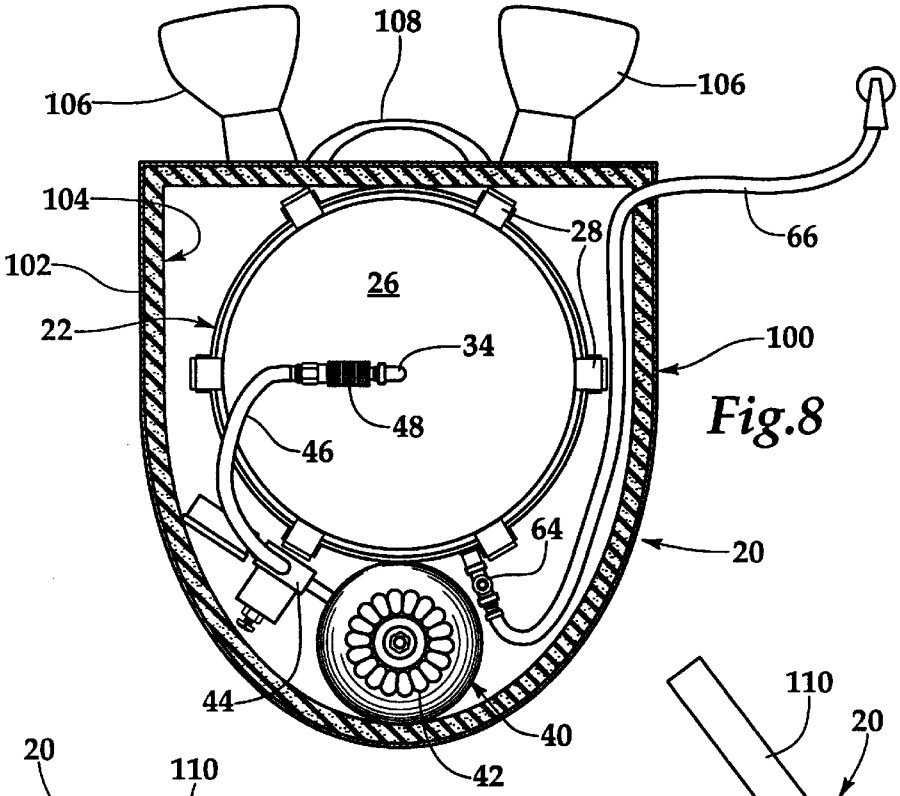
FIG. 8 is a sectional view illustrating an insulated backpack useful in the practice of the invention.
Figure 9:
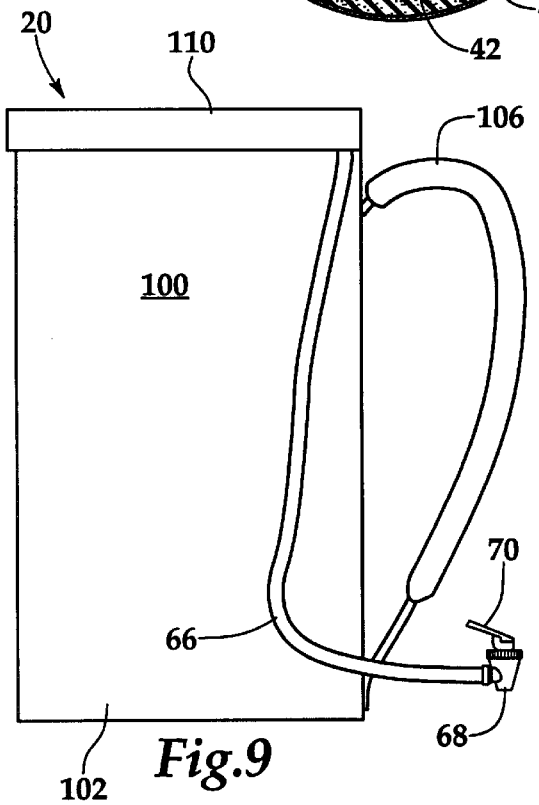
FIG. 9 is a side view of the insulated backpack of FIG. 8.
Figure 10:
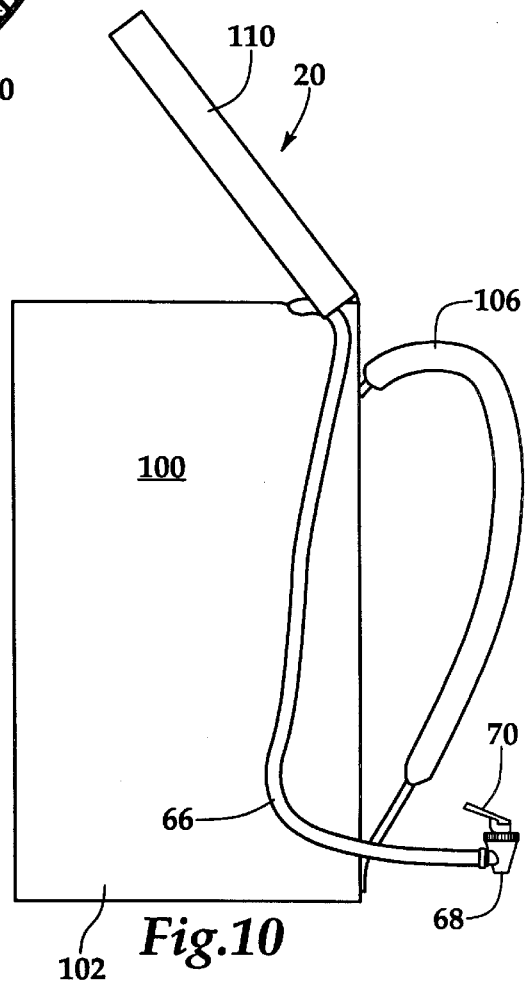
FIG. 10 is a view similar to FIG. 9 showing the lid of the insulated backpack opened to provide access to the contents thereof.

The insulated backpack 100 is further illustrated in FIGS. 8, 9, and 10. The insulated backpack 100 comprises an outer layer 102 formed from a tough, damage resistant fabric such as nylon. The insulated backpack 100 further comprises an inner layer 104 formed from an insulating material such as plastic foam. The backpack 100 is provided with shoulder straps 106 adapted to receive the shoulders of a vendor that will dispense a frozen beverage utilizing the portable frozen beverage dispenser 20 of the present invention. The backpack 100 may also be provided with a lifting handle 108. Access to the interior of the insulated backpack 100 is provided through a lid 110 which is pivotally supported.

Although preferred embodiments of the invention have been illustrated in the accompanying drawing and described in the foregoing detailed description, it will be understood that the invention is not limited to the embodiments disclosed but is capable of numerous rearrangements, modifications, and substitutions of parts and elements without departing from the spirit of the invention.

What is claimed is:

1. A portable dispensing apparatus for frozen beverages of the type comprising crushed or shaved ice and flavor containing liquid comprising:

a cylindrical frozen beverage receiving container having a top and bottom and a predetermined inside diameter for receiving frozen beverage in the bottom thereof and a bottom wall for containing the frozen beverage;

a frozen beverage dispensing outlet located in the cylinder adjacent the bottom wall of the frozen beverage receiving container;

a lid for the cylindrical container comprising a lower portion having an outside diameter substantially equal to the inside diameter of the cylinder and having an O-ring extending therearound to seal the interior of the cylinder and an upper portion larger in diameter than the cylinder for enlargement with the top thereof;

clamping means for securing the lid in engagement with the top of the cylinder;

a piston positioned in the frozen beverage receiving container above the level of the frozen beverage received therein;

said piston having an outside diameter substantially equal to the inside diameter of the cylinder and having a seal mounted thereon which has a diameter substantially larger than the inside diameter of the cylinder;

a source of pressurized gas;

means including a first quick disconnect coupling for initially directing pressurized gas from the source through the lid and into the top of the cylindrical container for initially imposing a downwardly directed force on the piston and thereby pressurizing the frozen beverage within the frozen beverage receiving container;

a dispensing valve for selective actuation to dispense frozen beverage from the frozen beverage receiving container through the dispensing outlet thereof under the action of the pressurization of the frozen beverage within the frozen beverage receiving container by the piston; and means including a second quick disconnect coupling for subsequently directing pressurized gas from the source to the bottom of the container through the dispensing outlet to force the piston upwardly in the container after the container has been substantially emptied.

2. The portable frozen beverage dispensing apparatus according to claim 1 further including:

a lid mounted at the top of the frozen beverage receiving container above the piston; and means for directing the pressurized gas into the space between the piston and the lid.

3. The portable frozen beverage dispensing apparatus according to claim 1 further including a fitting mounted on the frozen beverage receiving container for connection to a frozen beverage mixing machine to effect filling of the frozen beverage receiving container with a selected frozen beverage.

4. The portable frozen beverage dispensing apparatus according to claim 1 further including an insulated backpack for receiving and transporting the frozen beverage receiving container and the frozen beverage contained therein.

* * * * *

UNITED STATES PATENT AND TRADEMARK OFFICE

CERTIFICATE OF CORRECTION

PATENT NO. : 6,378,740 B1
DATED : April 30, 2002
INVENTOR(S) : Gary D. Martin

It is certified that error appears in the above-identified patent and that said Letters Patent is hereby corrected as shown below:

Column 4,
Line 14, replace “seeping part” with -- seeping past --.
Line 61, replace “illustrated in FIG. 7 The portable” with -- illustrated in FIG. 7. The portable --.

Column 5,
Lines 35-36, replace “frozen beverages of the type comprising” with -- frozen beverages comprising --.

Signed and Sealed this

Eighth Day of October, 2002

*Attest:*

*Attesting Officer*

JAMES E. ROGAN
*Director of the United States Patent and Trademark Office*